US005203529A

United States Patent [19]

Penniman

[11] Patent Number: 5,203,529

[45] Date of Patent: Apr. 20, 1993

[54] DEVICE TO SUSPEND POLYETHYLENE OR OTHER SHEETING AND COMPONENTS OF SUCH DEVICE

[76] Inventor: David T. Penniman, Roaring Brook Rd., Prospect, Conn. 06712

[21] Appl. No.: 628,935

[22] Filed: Dec. 14, 1990

Related U.S. Application Data

[63] Continuation-in-part of Ser. No. 471,529, Jan. 29, 1990, abandoned.

[51] Int. Cl.[5] ..... F16M 13/00

[52] U.S. Cl. ..... 248/228; 248/316.4; 248/317; 248/221.3; 248/231.4; 248/229

[58] Field of Search ..... 248/228, 229, 231.4, 248/287, 317, 323, 327, 58, 59, 72, 343, 508, 74.4, 68.1, 316.4, 221.3; 24/527, 528, 335

[56] References Cited

U.S. PATENT DOCUMENTS

| | | | |
|---|---|---|---|
| 347,489 | 8/1886 | Kenway | 248/59 |
| 802,087 | 10/1905 | Robinson | 248/59 |
| 1,055,345 | 3/1913 | McMahon | 248/228 |
| 1,141,203 | 6/1915 | Murph | 248/343 |
| 2,678,786 | 5/1954 | Kindorf | 248/72 |
| 2,751,175 | 6/1956 | Jones | 248/72 |
| 2,863,040 | 12/1958 | Marriett | 248/343 X |
| 3,325,135 | 6/1967 | Clarke | 248/508 |
| 3,377,038 | 4/1968 | Loudon | 248/327 |
| 4,135,692 | 1/1979 | Ferguson | 248/317 |
| 4,318,525 | 3/1982 | Welch | 248/228 |
| 4,928,917 | 5/1990 | Wolf | 248/508 X |
| 4,936,530 | 6/1990 | Wollar | 248/74.4 X |

FOREIGN PATENT DOCUMENTS

| | | | |
|---|---|---|---|
| 572287 | 3/1933 | France | 248/508 |
| 439 | 1/1984 | United Kingdom | 248/72 |

*Primary Examiner*—Alvin C. Chin-Shue
*Attorney, Agent, or Firm*—CTC & Associates

[57] ABSTRACT

A device to releasably suspend plastic sheeting from a building component includes a suspension member and a clamping member. The suspension member includes a ratcheted mechanism to removably affix it to a building component and a shank which incorporates both an upper fixed clamping surface of a clamping member and a number of circular ratchet teeth which are removably engaged by a lower clamping surface of the clamping member. The upper and lower clamping surfaces acting to compress and hold the sheeting without tearing the sheet.

2 Claims, 6 Drawing Sheets

FIG-12
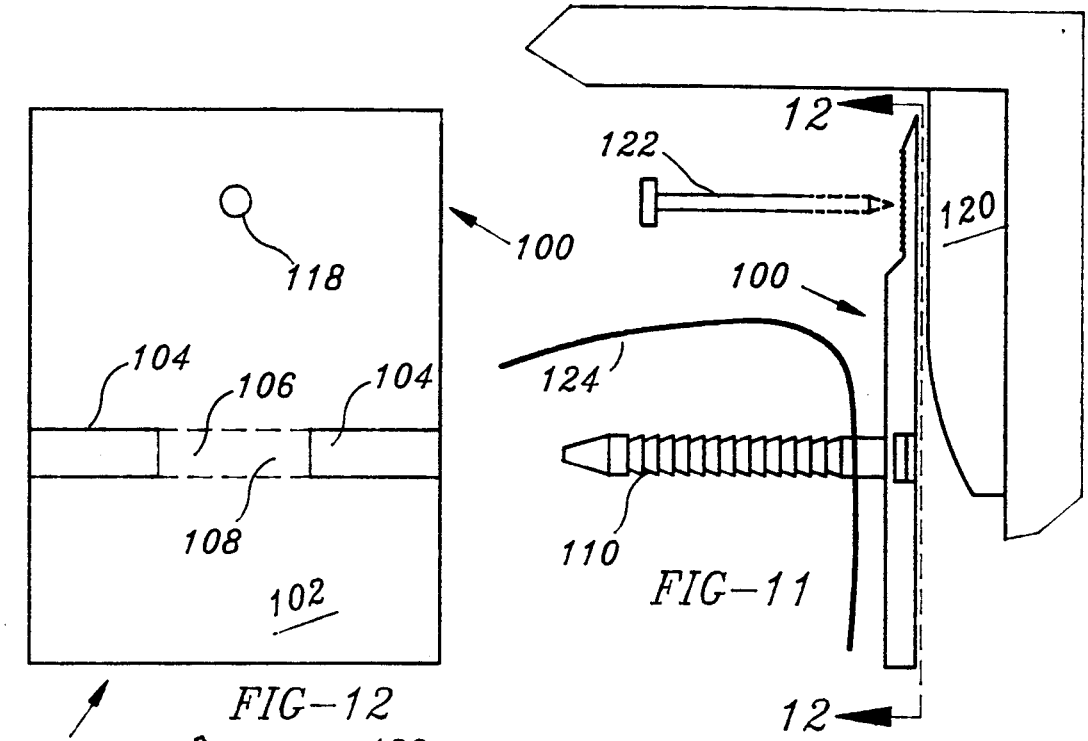
FIG-11
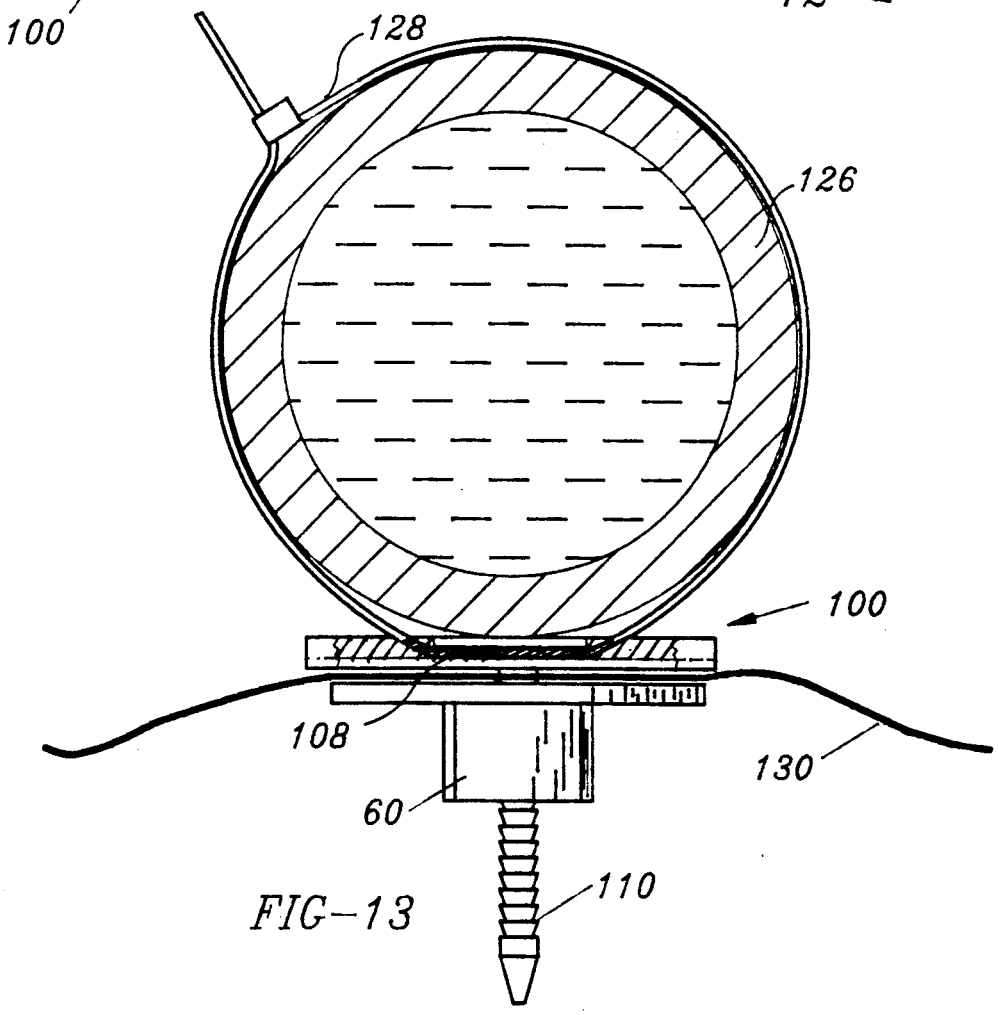
FIG-13

DEVICE TO SUSPEND POLYETHYLENE OR OTHER SHEETING AND COMPONENTS OF SUCH DEVICE

RELATED APPLICATION

This is a continuation-in-part of copending prior application Ser. No. 471,529 filed Jan. 29, 1990, abandoned.

BACKGROUND OF THE INVENTION

This invention relates to a device to suspend sheeting in a horizontal plane and to transmit the weight of the sheeting to building components, particularly ceiling components. The invention also relates to components of such device. In what follows, it will be assumed without limitation that the sheeting is polyethylene sheeting.

From about 1900 until the 1970s extensive amounts of carcinogenic asbestos were installed in buildings. Extensive efforts are now being made to remove such asbestos from locations back of walls and above ceilings. The present invention is particularly concerned with the removal of asbestos from locations above ceilings or to isolate particular areas of a room by suspending sheeting from the ceiling to the floor in effect creating a tunnel. Presently, some regulations require that as many as two layers of six mil polyethylene sheeting be temporarily installed on ceilings below spaces from which asbestos is to be removed. Alternatively the same regulations require as many as two layers of six mil polyethylene sheeting be temporarily installed surrounding an asbestos removal site such as asbestos flooring tile or asbestos covered pipes traversing an interior area.

At present, polyethylene sheeting is usually suspended from ceilings by make-shift systems involving wood furring strips, staples, spray glue and duct tape.

No prior art device is known for performing the function of suspending polyethylene sheeting from a ceiling either in a horizontal orientation, generally parallel to the ceiling or in a vertical orientation from ceiling to the floor.

The present invention fills the need for such a device.

Accordingly, the principal object of the invention is to provide a device and components thereof for suspending polyethylene sheeting from a ceiling in horizontal orientation.

Another object of the invention is to provide such a device and components which are simple and reliable to use.

A further object of the invention is to provide such a device and components which are of simple, inexpensive construction.

An additional object of the invention is to provide such a device and components which are highly versatile as to field conditions that can be accommodated.

The manner in which the invention achieves the foregoing and other objects and advantages will appear hereinafter.

SUMMARY OF THE INVENTION

The invention presents a device to suspend sheeting horizontally or vertically from ceiling building components in such manner to prevent tearing of the sheeting. The device includes a suspension member for being affixed to a building component, a piercing member to penetrate through the sheeting and a clamping member surrounding the piercing member to compressibly hold the sheeting to relieve the stress on the sheeting and prevent tearing. The device includes a suspension member for being affixed to a building component and has a shank with a plurality of circular ratchet teeth, a sharp sheeting piercing free end, a clamping surface spaced from the free end with the teeth between the free end and the clamping surface.

A clamping member has an axis, an external flange at one axial end, and an annular boss extends from the clamping surface to the other axial end. An opening extends from end to end of the clamping member, and the opening is interrupted by a pair of confronting jaws for releasably capturing the shank by engaging the ratchet teeth. The jaws have a gap therebetween which is enlargeable by manual squeezing pressure applied to the boss to enlarge the gap to release the jaws from engagement with the ratchet teeth.

In one embodiment, the suspension member is a two-component member and in another embodiment the suspension member is a one-component member.

The invention relates also to the suspension member alone, and further to the clamping member alone.

DESCRIPTION OF THE DRAWING

FIG. 11 is a view showing the suspension member of FIG. 5 suspending a piece of sheeting in a generally horizontal plane and transmitting the weight of the sheeting to a wall component adjacent a ceiling, but with no clamping member yet applied;

FIG. 12 is a view of the suspension member of FIG. 5 on line 12—12 of FIG. 11;

FIG. 13 is a view showing the suspension member of FIG. 5 suspended form a cylindrical object with a horizontal axis and with a clamping member of FIG. 7 clamping a piece of sheeting to the suspension member in a generally horizontal plane whereby the suspension member transmits the weight of the sheeting to the cylindrical object;

DESCRIPTION OF THE INVENTION

All of the elements of the inventive device are somewhat resilient and are preferably molded or otherwise formed of a high impact plastic material, such as polypropylene (PP), styrene-acrylonitrile-butadiene (ABS), high impact polystyrene (HIPS) and the like.

Figure 1:
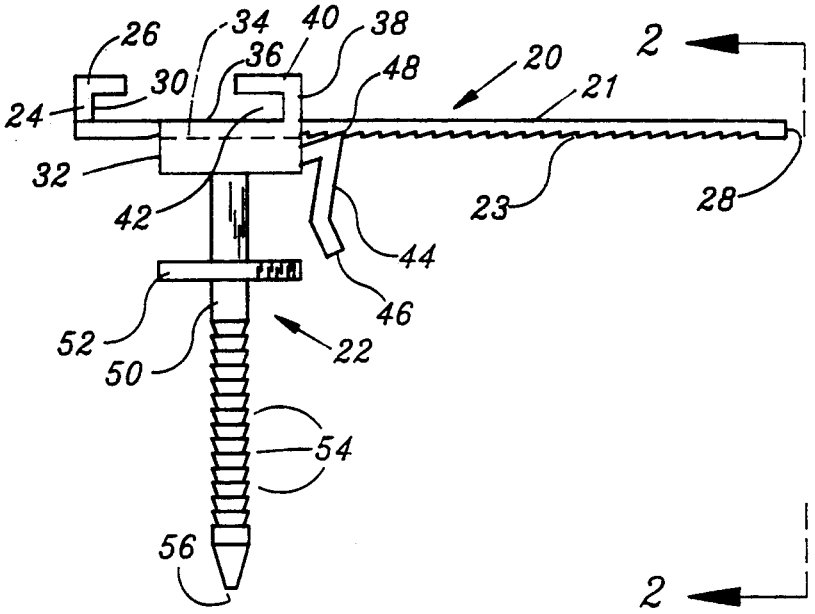
FIG. 1 is a side elevation of a two-component first example suspension member embodying the invention, the components including a retainer arm and a prong.
Figure 2:
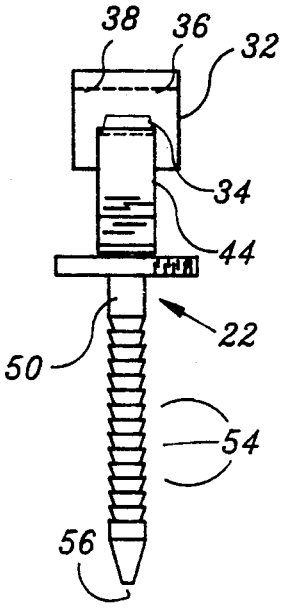
FIG. 2 is a view of the prong of FIG. 1 on line 2—2 of FIG. 1.
Figure 3:
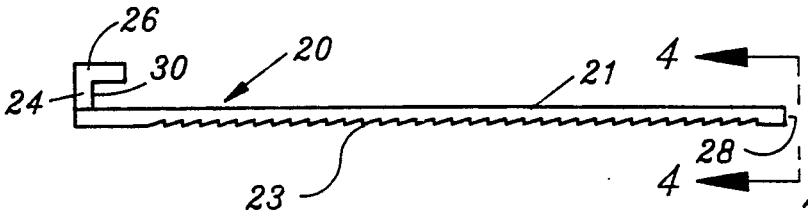
FIG. 3 is a side elevation of the retainer arm of FIG. 1.

FIG. 1 shows a two-component suspension member that is a first example of suspension member embodying the invention, including a retainer arm 20 and a prong 22. Retainer arm 20 and prong 22 are shown assembled with each other in FIG. 1 and also in FIGS. 9 and 10, while retainer arm 20 is shown by itself in FIGS. 3 and 4 and prong 22 is shown by itself in FIG. 2.

Figure 4:
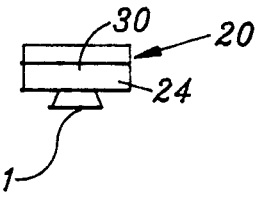
FIG. 4 is a view of the retainer arm on line 4—4 of FIG. 3.
Figure 9:
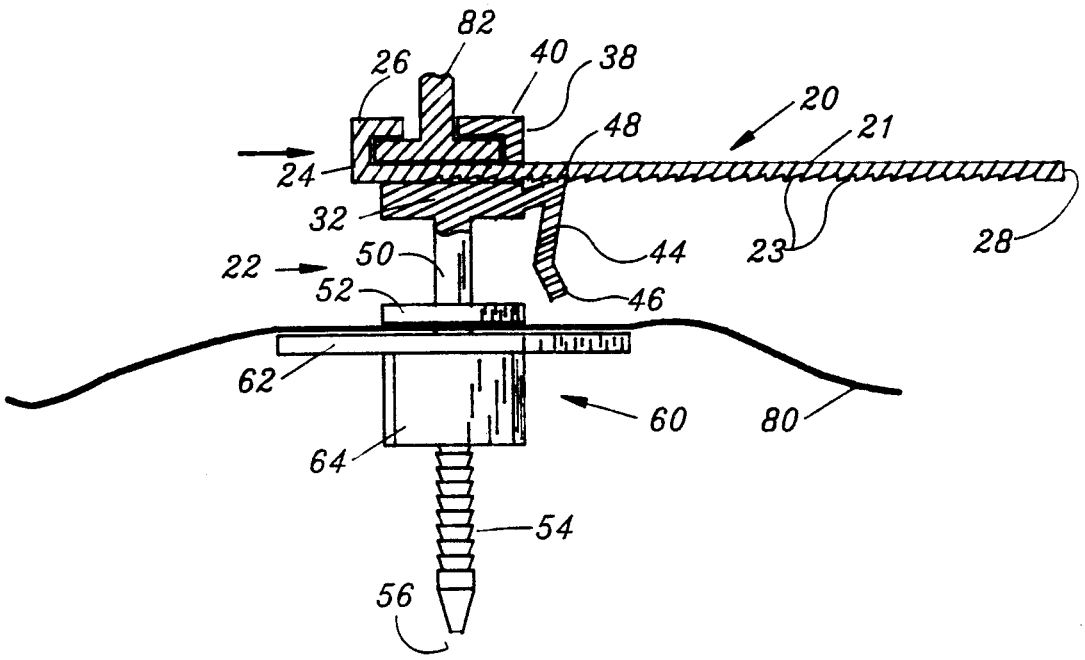
FIG. 9 is a view showing a device comprising the suspension member of FIG. 1 and the clamping member of FIG. 7 clamping a piece of sheeting to the suspension member in a generally horizontal plane whereby the suspension member transmits the weight of the sheeting to a ceiling component.
Figure 10:
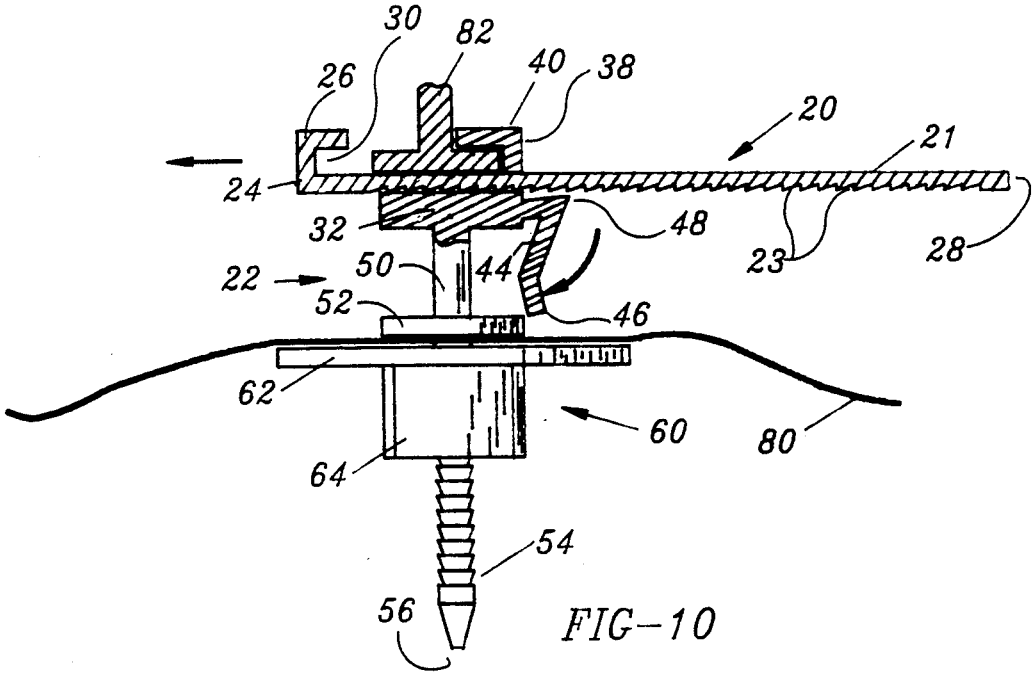
FIG. 10 is a view similar to FIG. 9 but showing the suspension member being released from the ceiling component.

Retainer arm 20 has an elongated arm portion 21 of constant size and shape, the shape being a dovetail configuration as best seen in FIG. 4. The upper face of arm portion 21 is smooth and substantially flat while the lower face is provided with ratchet teeth 23 as best seen in FIGS. 1, 9 and 10.

At one end of arm portion 21 retainer arm 20 is provided with an upturned end flange 24 and a retainer flange or upper flange 26 extends from the upper end of end flange 24 in the direction to overlie arm portion 21. The other end of arm portion 21 is a free end 28. Arm portion 21, end flange 24 and upper flange 26 define a groove 30 extending crosswise of retainer arm 20 and facing free end 28.

Prong 22 has a head 32 with a dovetail groove 34 in upper surface 36 of head 32, groove 34 extending from one end of head 32 to the other and shaped and sized to receive and retain arm portion 21 of retainer arm 20. Head 32 also has an end flange 38 upturned from upper surface 36 at one end thereof and a retainer flange 40. Upper surface 36, end flange 38 and retainer flange 40 define a groove 42 (best seen in FIG. 1) extending crosswise of head 32 and facing the end of head 32 remote from end flange 38.

Extending outwardly from the end of head 32 from which end flange 38 rises is a resiliently flexible arm 44 having a free end 46 and an upwardly facing sharp edge 48 parallel to end flange 38. Normally edge 48 is slightly above the plane of the bottom of groove 34.

Prong 22 also has a shank 50 defining an axis and depending from head 32 and perpendicular to the bottom of groove 34. Shank 50 is plain and cylindrical adjacent head 32 and spaced from head 32 has an external circular flange 52 providing a clamping surface for polyethylene (or other) sheeting. Shank 50 continues on the side of clamping flange 52 remote from head 32 where shank 50 is provided with closely spaced circular ratchet teeth 54 that are tapered so that each tooth 54 is smallest in diameter at its axial end remote from clamping flange 52.

Shank 50 terminates at a sharp free end 56.

Relatively slight manual pressure applied to arm 44 toward the axis of shank 50 will suffice to lower sharp edge 48 to the level of the bottom of groove 34 or slightly below that level, as seen in FIG. 10, to permit withdrawal of retainer arm 20 from prong 22.

Figure 7:
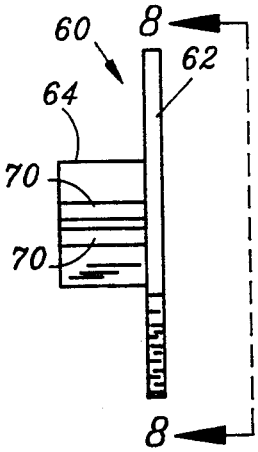
FIG. 7 is a side elevation of a clamping member embodying the invention.
Figure 8:
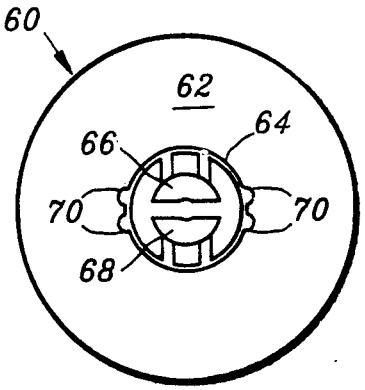
FIG. 8 is a view of the clamping member of FIG. 7 on line 8—8 of FIG. 7.

FIGS. 7 and 8 show a one-piece clamping member 60 having a main axis and an external circular flange 62 at one axial end and perpendicular to the axis and of an external diameter about twice the diameter of flange 52 of prong 22. Coaxial with flange 62 clamping member has an annular boss 64 at the other axial end of member 60. An internal cylindrical opening extends through member 60 from one axial end to the other, interrupted by two confronting jaws 66 and 68 with a gap therebetween and with concave cylindrical surfaces with axes parallel to and spaced from the main axis of member 60. Boss 64 is provided with external longitudinal ridges 70 which can be felt with one's fingers. Ridges 70 are substantially aligned with the gap between jaws 66 and 68.

Figure 8A:
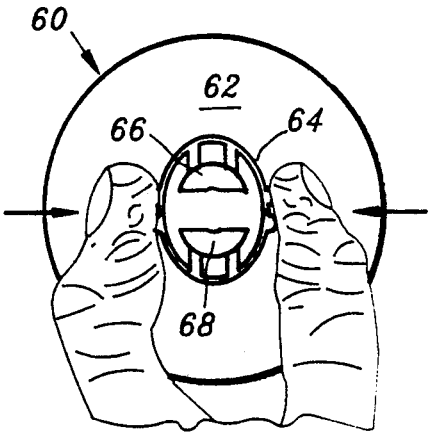
FIG. 8A is similar to FIG. 8 but showing the clamping member temporarily slightly resiliently deformed.

Free end 56 of shank 50 can be pushed through the opening through clamping member 60, and teeth 54 will engage and spread clamping jaws 66 and 68, whereby shank 50 will become captive in clamping member 60. This capture of shank 50 in clamping member 60 can be undone by the simple expedient of grasping boss 64 between one's thumb and a finger and exerting squeezing pressure on ridges 70 in the direction of the arrows in FIG. 8A, thus spreading clamping jaws 66 and 68 away form each other as shown in FIG. 8A to permit withdrawal of teeth 54 and separation of clamping member 62 from prong 22.

FIGS. 9 and 10 illustrate the use of a device comprising the suspension member of FIG. 1, i.e., retainer arm 20 and prong 22, and clamping member 60, in suspending polyethylene (or other) sheeting 80 generally horizontally from a flange member 82 shaped like an inverted T, with two flanges oppositely protruding from the bottom of a vertical rail. Flange member 82 may be a preexisting ceiling component or may be affixed to a ceiling (not shown) for the purpose of temporarily suspending sheeting 80.

FIG. 9 shows retainer arm 20 assembled with prong 22 as shown in FIG. 1, but with arm portion 21 having been pushed through head 32 as far as it will go with the two flanges at the bottom of flange member 82 in grooves 30 and 42, and so held by engagement of sharp edge 48 with an appropriate one of ratchet teeth 23 on arm portion 21. Thus, suspension member comprising arm portion 21 and prong 22 is suspended from flange member 82 with shank 50 vertically oriented with free end 56 pointing downwardly.

Sheeting 80 has been pushed upwardly onto shank 50 as far as it will go such that free end 56 has pierced sheeting 80 and sheeting 80 engages clamping flange 52, and clamping member 60 having been pushed upwardly onto shank 50 in the manner previously described until flange 62 engages sheeting 80 to clamp the same against flange 52, then pertinent parts being held in the FIG. 9 position by engagement of confronting jaws 66 and 68 with the appropriate ratchet tooth 54 on shank 50.

Clamping member 60 will remain in the FIG. 9 position until it is deliberately removed from engagement with prong 22 in the manner described above in connection with FIG. 8A.

FIG. 10 shows edge 48 having been released from engagement with teeth 23 so that retainer arm 20 can be withdrawn from engagement with prong 22 by movement to the left in the direction of the arrow. This will also move groove 30 away from groove 42 and hence will allow removal of retainer arm 20 and prong 22 from flange 82.

It should be mentioned that normally the parts would not be in the position of FIG. 10. Instead, clamping member 60 and sheeting 80 would be removed from prong 22 prior to removal of retainer arm 20 and prong 22 from flange member 82.

Figure 5:
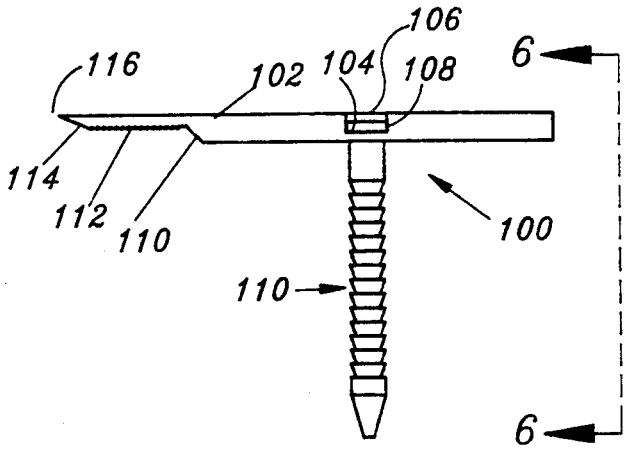
FIG. 5 is a side elevation of a one-component second example of suspension member embodying the invention.
Figure 6:
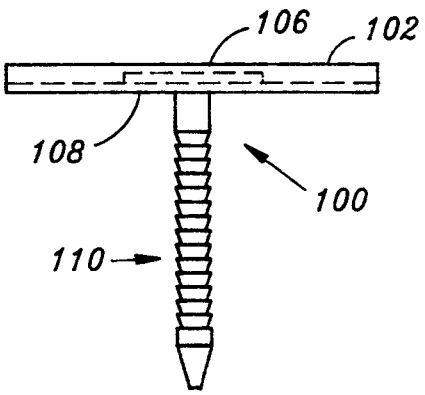
FIG. 6 is a view of the suspension member on line 6—6 of FIG. 5.
Figure 17:
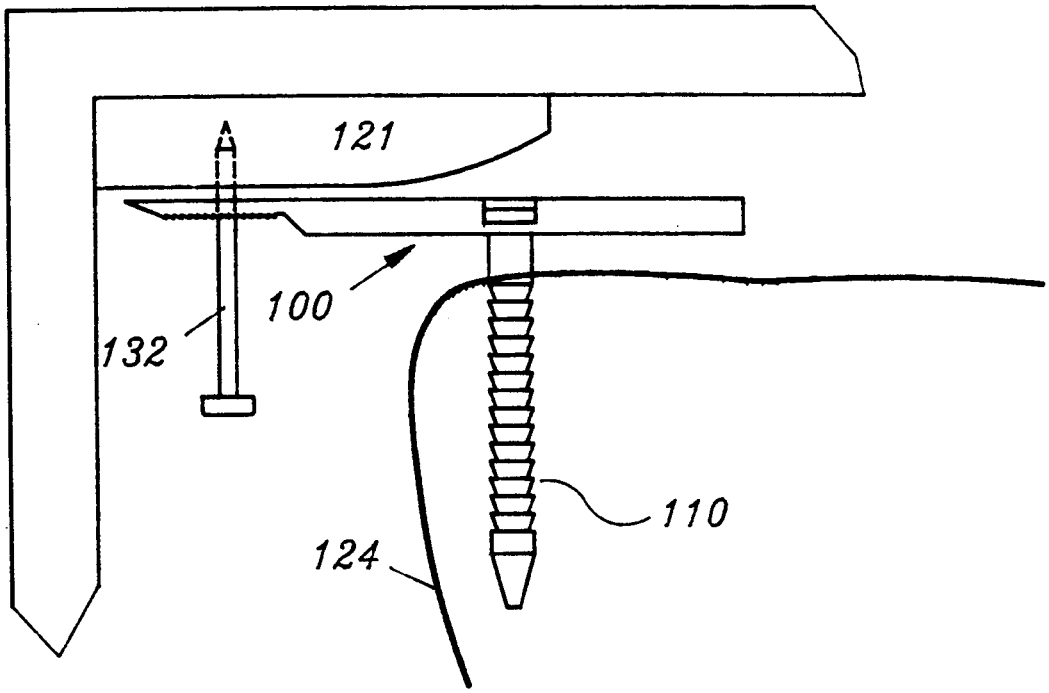
FIG. 17 is a view showing the suspension member of FIG. 5 suspending a piece of sheeting in a generally vertical plane and transmitting the weight of the sheeting to a ceiling component adjacent to a wall, but with no clamping member yet applied.

FIGS. 5, 6 and 17 illustrate a suspension member 100 which is a one-component second example of a suspension member embodying the invention. Suspension member 100 has a plate 102 which is generally rectangular (see FIG. 12) with a groove 104 extending across one face of plate 102 The longitudinally central portion of groove 104 extending across one face of plate 102. The longitudinally central portion of groove is bridged over at 106 to provide an open-ended tunnel 108. A shank 110 extends at a right angle to the face of plate 102 opposite the face with groove 104 and tunnel 108. Shank 110 is indistinguishable form the portion of shank 50 of prong 22 that is between flange 52 and end 56 and need not be described further. Plate 102 of suspension member 100 provides a clamping flange equivalent clamping flange 52 of prong 22 and providing a clamping surface. Also, shank 110 is usable with clamping member 60 unchanged and in the same manner.

A portion of the face of plate 102 from which shank 110 extends is beveled at 110 to a reduced thickness toothed area 112 and thence is beveled again at 114 to a sharp edge 116, all as shown in FIG. 5.

Further, plate 102 may be provided with a hole 118 as shown in FIG. 12.

FIGS. 11, 13, 14, 15 and 16 show typical applications of suspension member 100, and bring out the versatility of member 100 and the simplicity of its use.

FIG. 11 shows suspension member 100 simply fastened to a vertical moulding 120 via a nail 122 passing through hole 118. A piece of sheeting 124 (polyethylene or otherwise) has been applied to shank 110 which in this instance is horizontal. However, sheeting 124 is still in the main horizontal.

FIG. 13 shows a horizontal cylindrical hot water pipe 126, with a clamping strap 128 therearound and passing through tunnel 108 of suspension member 100. FIG. 13 also shown clamping member 60 applied to shank 110 and a piece of sheeting 130.

Figure 14:
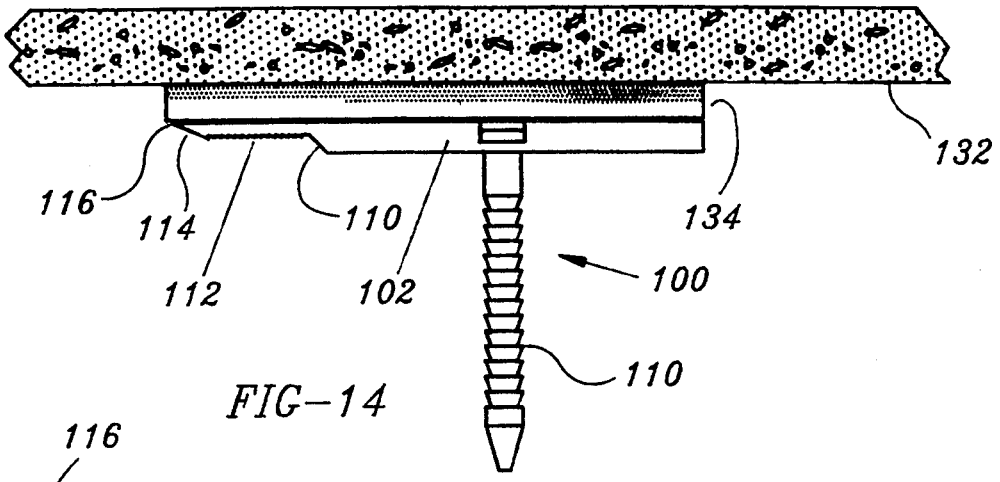
FIG. 14 is a view showing the suspension member of FIG. 5 suspended from a ceiling via an intermediate ceiling component and ready to perforate a piece of sheeting to hold same and to receive a clamping member of FIG. 7 to enable the suspension member to transmit the weight of the sheeting to the ceiling.

FIG. 14 shows suspension member 100 affixed to a ceiling 132 via a layer 134 of adhesive secured to ceiling 132 and to member 100.

Figure 15:
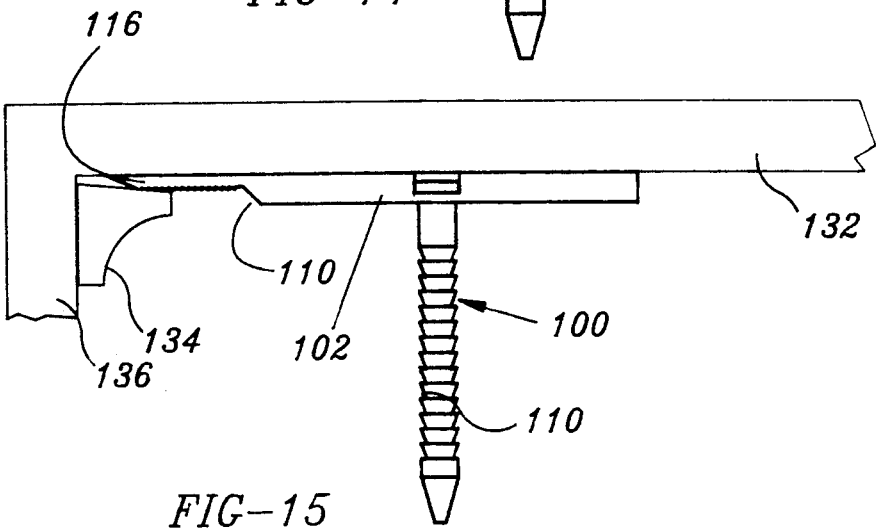
FIGS. 15 and 16 are views showing the suspension member of FIG. 5 suspended from ceiling components and ready to perforate a piece of sheeting to hold same and to receive a clamping member of FIG. 7 to enable the suspension member to transmit the weight of the sheeting to the ceiling component.

FIG. 15 shows suspension member 100 installed by wedging sharp edge 116 between a ceiling 132 and a moulding 134 on a wall 136 adjacent ceiling 132.

Figure 16:
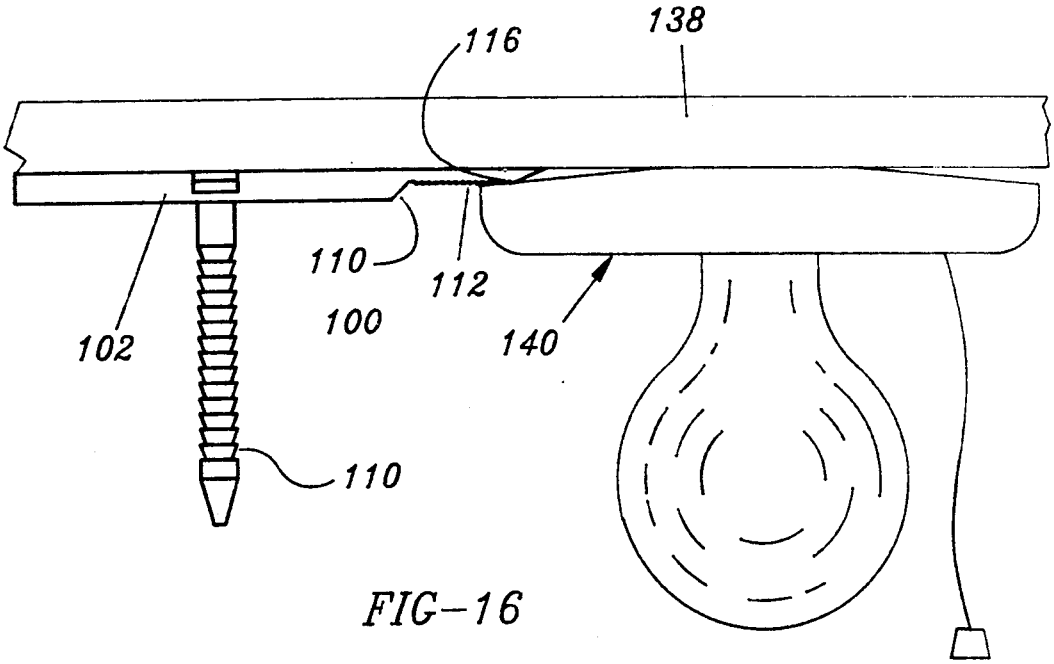

FIG. 16 shows suspension member 100 installed by wedging sharp edge 116 into a space between a ceiling 138 and the base of a light fixture 149 mounted on ceiling 138.

FIG. 17 shows suspension member 100 in the vertical mode being fastened to a wide ceiling corner moulding 121 via nail 122 passing through hole 118. A piece of sheeting 124 has been applied to shank 110 which in this instance is vertical and sheeting 124 is in the main vertical.

It is apparent that the invention achieves the foregoing objects and advantages among others.

The disclosed details are exemplary only and are not to be taken as limitations on the invention except as those details are included in the appended claims.

What is claimed is:

1. A device to suspend sheeting from a building component said device having an upper member for being removably affixed to said building component and lower member for suspending sheeting, said lower member having a suspension member and a releasable clamping member, said suspension member having a shank with a plurality of circular ratchet teeth, a sharp piercing free end, and a fixed upper clamping surface, said ratchet teeth spaced between said fixed upper clamping surface and said sharp piercing free end; said releasable clamping member having a clamping surface and an axis and an axial opening for insertion of said shank, said releasable clamping surface being formed by an external flange, an annular boss extending from said external flange, said axial opening extending from end to end of said annular boss and said external flange, said axial opening interrupted by a pair of confronting jaws for releasably capturing said shank when inserted therethrough by engaging said ratchet teeth, said jaws having a gap therebetween which is enlargeable by applying manual squeezing pressure to said boss thereby enlarging said gap to release said jaws from engagement with said ratchet teeth, said sheeting being supported between said fixed upper clamping member and said removable clamping surface.

2. A device according to claim 1 to suspend sheeting from a building component said device's upper member for being removably affixed to said building comprises a retainer arm and prong, said retainer arm having an arm portion of dovetail configuration with a free end and an upper smooth face and a lower face with ratchet teeth, said prong providing said shank and a head including an upper surface with a dovetail groove sized to receive said arm portion, said head also having an end flange upturned from said upper surface and a retainer flange overlying said upper surface; said upper surface, said end flange and said retainer flange defining a groove facing the end of said head remote from said end flange, a resiliently flexible arm having an upwardly facing sharp edge normally above the bottom of said groove in said upper surface of said head, whereby said sharp edge permits passage of said ratchet teeth on said arm portion in one direction but not in the opposite direction; said retainer arm further having at the end remote from said free end an upturned end flange and a retainer flange overlying said arm position to define a groove facing said free end, said grooves confronting each other to receive and releasably hold a building component therein.

* * * * *